US006425377B1

(12) United States Patent
Marx et al.

(10) Patent No.: US 6,425,377 B1
(45) Date of Patent: Jul. 30, 2002

(54) FUEL DELIVERY UNIT

(76) Inventors: Peter Marx, Kölnische Str. 152, 34119 Kassel; Christoph Schmidt, Zur Schlossquelle 8 a, 36199 Rotenburg; Hans-Dieter Wilhelm, Hattsteiner Weg 6, 61267 Neu Anspach; Thomas Werner, Ligueiler Str. 6, 36214 Nentershausen, all of (DE)

( * ) Notice: Subject to any disclaimer, the term of this patent is extended or adjusted under 35 U.S.C. 154(b) by 0 days.

(21) Appl. No.: 09/490,339

(22) Filed: Jan. 24, 2000

(30) Foreign Application Priority Data

Jan. 22, 1999 (DE) ..... 199 02 427

(51) Int. Cl.[7] ..... F02M 37/04

(52) U.S. Cl. ..... 123/509; 123/514; 417/244; 137/576

(58) Field of Search ..... 123/509, 514, 123/516, 510; 137/565.3, 574, 576; 417/244, 423.5

(56) References Cited

U.S. PATENT DOCUMENTS 4,125,345 A * 11/1978 Yoshinaga et al. ..... 417/243
5,009,575 A * 4/1991 Hanai et al. ..... 417/244
5,050,567 A * 9/1991 Suzuki ..... 123/514
5,111,844 A * 5/1992 Emmert et al. ..... 137/567
5,435,691 A * 7/1995 Braun et al. ..... 415/55.6
5,525,039 A * 6/1996 Sieghartner ..... 417/32
5,584,279 A * 12/1996 Brunnhofer ..... 123/541
5,718,208 A * 2/1998 Brautigan et al. ..... 123/516
5,960,775 A * 10/1999 Tuckey ..... 123/509

FOREIGN PATENT DOCUMENTS

DE R.N. G8705763.8 7/1987 ..... F02M/37/18
DE 3941147 A1 6/1991 ..... F02M/37/18
DE 4242242 A1 6/1994 ..... F02M/37/14
DE 19501353 A1 7/1996 ..... F02M/37/18

* cited by examiner

*Primary Examiner*—Carl S. Miller
(74) *Attorney, Agent, or Firm*—Mayer, Brown, Rowe & Maw

(57) ABSTRACT

In a fuel delivery unit for a motor vehicle, having a delivery pump which has a preliminary stage and a main stage, an outlet channel of the preliminary stage is guided radially outward and configured such that it rises upward. An inlet channel of the main stage is guided laterally past the preliminary stage. In accordance with this design, impellers of the delivery pump can be arranged particularly low down and gas bubbles are guided away out of the preliminary stage in a very simple manner.

6 Claims, 2 Drawing Sheets

FUEL DELIVERY UNIT

BACKGROUND OF THE INVENTION

1. Field of the Invention

The present invention relates generally to the field of fuel delivery units. More specifically, the present invention is directed to a motor vehicle fuel pump installed in a fuel tank having a preliminary stage and a main stage. The device desirably includes an anti-surge cup provided for filling by the preliminary stage in order to collect fuel for the main stage, which feeds from the anti-surge cup. The preliminary stage and the main stage be driven by a vertical shaft.

2. Description of the Related Art

Fuel delivery units similar to this type are frequently used in today's motor vehicles and are known from practice. In the case of the known fuel delivery unit, the preliminary stage and the main stage of the fuel pump are in each case configured as peripheral pumps and have impellers fastened on the vertical shaft. The vertical shaft is a motor shaft of an electric motor likewise arranged in the anti-surge cup. The preliminary stage is generally arranged below the main stage and fills the anti-surge cup via an ascending pipe. The main stage sucks in fuel from the anti-surge cup and generates pressure necessary for an internal combustion engine of the motor vehicle. Because of this, the fuel delivery unit turns out to be very compact.

A disadvantage of the known fuel delivery unit is that it is of a very large size and that the impellers of the delivery pump are arranged very high up in the fuel delivery unit. As a result, a very high fuel level is required in each case in the fuel tank and in the anti-surge cup for the fuel delivery unit to be able to deliver fuel. When there is a very high level in the fuel tank, there is also the risk, particularly when the fuel tank is going round a corner or when the fuel is hot, of the preliminary stage sucking in air or fuel vapors and producing foam with the fuel and delivering the foam into the anti-surge cup.

The invention is based on the problem of designing a fuel delivery unit of the type mentioned at the beginning in such a manner that it is constructed in a particularly compact manner, and that the impellers of the delivery pump are arranged as low down as possible.

SUMMARY OF THE INVENTION

According to the invention, this problem is solved by the preliminary stage having an outlet channel which points radially outward and rises upward. By means of this design, gas bubbles present in the preliminary stage can be guided away via its outlet channel in a very simple manner. Outside the delivery pump the outlet channel can be deflected into the perpendicular ascending pipe of the known fuel delivery unit. Because the outlet channel rises upward, a column of liquid present in the ascending pipe cannot adversely affect the escape of the gas bubbles. Since the outlet channel of the preliminary stage is guided radially, the impellers of the preliminary stage and of the main stage can be arranged very close together and can be mutually arranged very close to the bottom region of the fuel tank. As a result, a particularly low level is required in the fuel tank in order to operate the fuel delivery unit according to the invention. The fuel delivery unit according to the invention additionally turns out to be particularly compact.

A contribution is made to further reducing the dimensions of the fuel delivery unit according to the invention if the main stage has a vertical inlet channel leading from a delivery chamber of the main stage as far as the bottom region of the anti-surge cup. A further advantage of this design is the fact that the delivery pump has, apart from the deflection at the ascending pipe, straight inlet channels and outlet channels. As a result, the risk of hot fuel evaporating is kept particularly small.

According to another advantageous development of the invention, the delivery pump is constructed in a structurally simple manner if the outlet channel of the preliminary stage widens continuously from the delivery chamber of said preliminary stage. The preliminary stage could be configured, for example, as a peripheral pump having blade chambers arranged in the periphery of the impeller. However, this requires the impeller to be set precisely to the delivery pump's axial clearance. According to another advantageous development of the invention, this type of setting can be avoided in a simple manner if the preliminary stage is designed as a side channel pump, and the delivery chamber is arranged exclusively in one of its end sides. As a result, different pressures prevail on the end sides of the impeller of the preliminary stage, so that the impeller is pressed to the side having the lower pressure. This effect is additionally assisted by leakage of fuel overflowing from the main stage on the shaft to the preliminary stage.

According to another advantageous development of the invention, the delivery pump can be manufactured particularly cost-effectively if the impeller of the preliminary stage, together with a housing part of the fuel pump, which housing part is part of a delivery chamber, is configured as an axial bearing for the fuel pump. It is preferred that an electric motor be used for driving the fuel pump. In order to form the axial bearing, the impeller and the housing part may, for example, have a slidable coating or pockets for producing a sliding film from fuel.

Fuel flowing back into the fuel tank from the internal combustion engine of the motor vehicle is generally fed to the anti-surge cup. According to another advantageous development of the invention, the fuel is prevented from heating up in the preliminary stage if a housing wall between the preliminary stage and the main stage is manufactured from a thermal-insulating material. By this means, the risk of evaporation of the fuel in the inlet channel of the preliminary stage is kept particularly small.

According to another advantageous development of the invention, a contribution to further reducing the transfer of heat from the main stage to the preliminary stage is made if blade chambers of the preliminary stage are arranged on that end side which faces away from the main stage. According to another advantageous development of the invention, fuel sucked in from the preliminary stage can be particularly reliably prevented from swirling if the anti-surge cup has a recess in the center of its bottom region for sucking-in fuel by the preliminary stage, and if an inlet channel of the preliminary stage is arranged running vertically toward the impeller of the preliminary stage. As a result, the fuel delivery unit according to the invention furthermore turns out to be particularly compact. The delivery unit according to the invention can also be produced and fitted in a simple manner.

BRIEF DESCRIPTION OF THE DRAWINGS

The exemplary embodiment is described below with reference to the drawings, wherein.

DETAILED DESCRIPTION OF THE PREFERRED EMBODIMENTS

Figure 1:
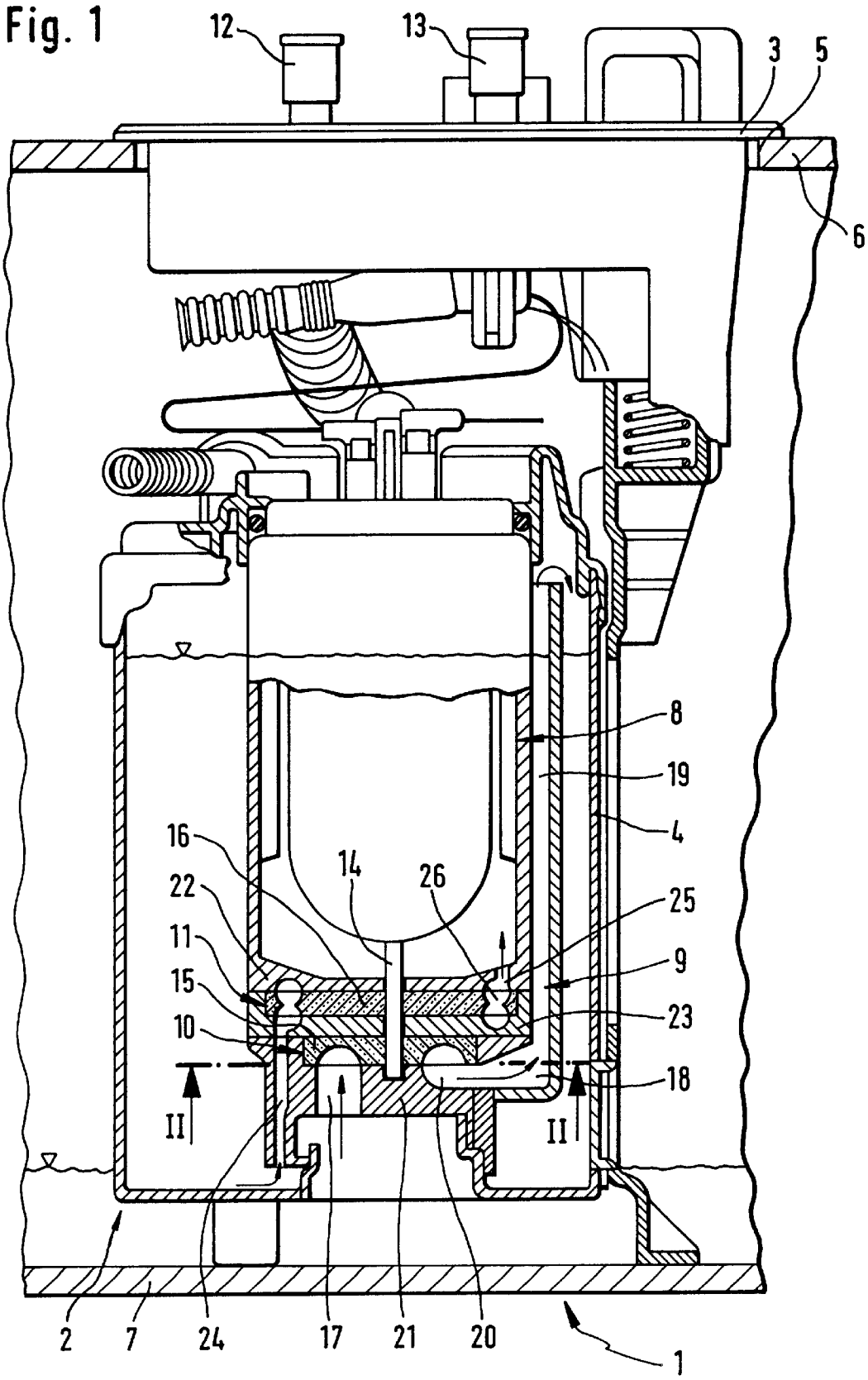
FIG. 1 is a schematic representation of a fuel delivery unit according to the invention, in a longitudinal section.

FIG. 1 shows, schematically and in longitudinal section, a fuel delivery unit 2 according to the invention which is fitted in a fuel tank 1. The fuel delivery unit 2 has a flange 3 and an anti-surge cup 4. The flange 3 serves to fasten it in a recess 5 in an upper wall 6 of the fuel tank 1. The anti-surge cup 4 is pretensioned against a bottom 7 of the fuel tank 1. A delivery pump 9, which is driven by an electric motor 8 and has a preliminary stage 10 and a main stage 11, is arranged in the anti-surge cup 4. In order to simplify the drawing, only partial sections of the electric motor 8 and the anti-surge cup 4 are shown. The preliminary stage 10 serves for delivering fuel from the fuel tank 1 into the anti-surge cup 4. The main stage 11 sucks in fuel from the anti-surge cup 4 and delivers it to a connecting pipe 12 arranged on the outside of the flange 3 of the fuel delivery unit 2. A feed line leading to an internal combustion engine (not shown) can be connected to the connecting pipe 12. The flange 3 furthermore has a connecting pipe 13 for a return line (likewise not shown) which leads back into the fuel tank 1 from the internal combustion engine. Fuel flowing back passes either directly into the anti-surge cup 4 or initially to a sucking jet pump (likewise not shown) which is fitted in the fuel tank 1. The sucking jet pump then delivers fuel into the anti-surge cup 4.

The preliminary stage 10 and the main stage 11 are in each case designed as side channel pumps and have a respective impeller 15, 16 fitted on a shaft 14. The shaft 14 is a motor shaft of the electric motor. The preliminary stage 10 has an inlet channel 17 running perpendicularly toward the impeller 15 from the bottom region of the fuel tank 1. An outlet channel 18 of the preliminary stage 10 points radially outward and rises upward. The outlet channel 18 subsequently opens into an upwardly open ascending pipe 19. A delivery chamber 20, which leads from the inlet channel 17 to the outlet channel 18, is exclusively arranged on that side of the impeller 15 which faces away from the main stage 11. The delivery chamber 20 is situated half in the impeller 15 and half in a housing part 21 which is opposite the impeller 15. The housing part 21 and the impeller 15 form an axial bearing for the delivery pump 9 and the electric motor 8. The main stage 11 has two housing parts 22, 23 which are opposite the impeller 16 and have a delivery chamber 26 leading from an inlet channel 24 through the impeller 16 to an outlet channel 25. The inlet channel 24 of the main stage 11 is arranged in the lower housing part 23, while the outlet channel 25 is situated in the upper housing part 22. The cross-sectional area of the delivery chamber 20 of the preliminary stage 10 is approximately twice as large as the cross-sectional area of the delivery chamber 26 of the main stage 11.

Figure 2:
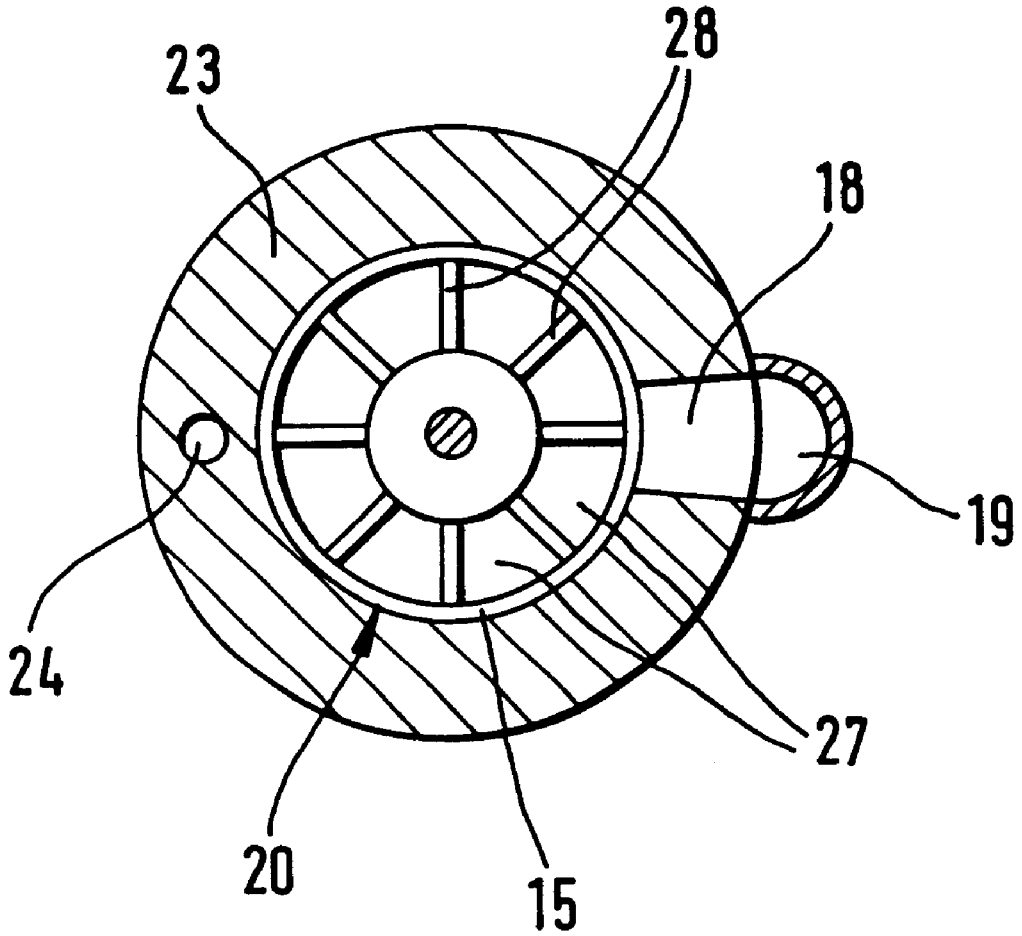
FIG. 2 a sectional representation through a preliminary stage of the fuel delivery unit from FIG. 1, along the line II—II.

In a sectional representation through the delivery pump 9 from FIG. 1 along the line II—II, FIG. 2 shows that the impeller 15 of the preliminary stage 10 has a plurality of blade chambers 27. The blade chambers 27 are in each case bounded by guide blades 28. When the impeller 15 rotates, the guide blades 28 generate a circulatory flow in the delivery chamber 20.

We claim:

1. A fuel delivery unit for a motor vehicle, comprising:

a fuel pump having a preliminary stage and a main stage;

an anti-surge cup arranged to receive fuel from the preliminary stage;

the main stage, receiving fuel from the anti-surge cup, the preliminary stage and the main driven by a vertical shaft, wherein the preliminary stage has an outlet channel which points radially outward and rises upward and wherein the outlet channel of the preliminary stage widens continuously from the delivery chamber of said preliminary stage and further wherein the main stage has a vertical inlet channel leading from a delivery chamber and the vertical inlet channel is directly beneath an impeller of the main stages.

2. The fuel delivery unit as claimed in claim 1, wherein the preliminary stage is designed as a side channel pump, and the delivery chamber is exclusively arranged in an end side.

3. The fuel delivery unit as claimed in claim 1, wherein the impeller of the preliminary stage, and a housing part of the delivery pump, which is part of the delivery chamber, is configured as an axial bearing for the delivery pump.

4. The fuel delivery unit as claimed in claim 1, wherein a housing part between the preliminary stage and the main stage is manufactured from a thermal-insulating material.

5. The fuel delivery unit as claimed in claim 1, wherein blade chambers of the preliminary stage are arranged on an end side which faces away from the main stage.

6. The fuel delivery unit as claimed in claim 1, wherein the anti-surge cup has a recess in a center of a bottom region for feeding fuel to the preliminary stage, and wherein an inlet channel of the preliminary stage runs vertically toward the impeller of the preliminary stage.

* * * * *